US006158380A

United States Patent [19]

Aschauer et al.

[11] Patent Number: 6,158,380

[45] **Date of Patent: *Dec. 12, 2000**

[54] SAVING APPARATUS FOR PERSONS IN AVALANCHES

[76] Inventors: Peter Aschauer, An der Dornwiese 3, D - 82166 Gräfelfing; Helmuth Bauer, Haberskirchener Strasse 22, D - 84333 Malgersdorf, both of Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/991,746

[22] Filed: Nov. 7, 1997

Related U.S. Application Data

[63] Continuation of application No. PCT/EP96/01942, May 9, 1996.

[30] Foreign Application Priority Data

May 9, 1995 [DE] Germany ..... 195 16 872

[51] Int. Cl.[7] ..... B63C 9/15

[52] U.S. Cl. ..... 116/210; 182/3; 441/93; 441/114

[58] Field of Search ..... 116/210; 182/3; 441/80, 92, 93, 94, 106, 108, 111, 112, 114, 116, 121; 220/581–584; 206/0.6

[56] References Cited

U.S. PATENT DOCUMENTS

| | | | |
|---|---|---|---|
| 1,632,447 | 7/1927 | Lemoine | 220/582 |
| 3,951,260 | 4/1976 | Frazee | 116/210 |
| 4,635,754 | 1/1987 | Aschauer et al. . | |
| 5,429,244 | 7/1995 | McCreary | 116/210 |

FOREIGN PATENT DOCUMENTS

| | | | |
|---|---|---|---|
| 366 917 | 5/1982 | Germany . | |
| 33 00 841 | 7/1984 | Germany . | |
| 584042 | 1/1977 | Switzerland | 116/210 |

*Primary Examiner*—Andrew H. Hirshfeld
*Attorney, Agent, or Firm*—Helfgott & Karas, P.C.

[57] ABSTRACT

Lifesaving device for people in avalanches with two balloons at least one balloon is a tear-resistant balloon, which can be securable close to a user's body by means of an attachment. In an emergency the device is inflated by mean of pressurized gas so that it, just like a buoyancy body, keeps its user at the surface of the avalanche. A filling device connects at least one of the balloons to at least one pressurized gas container. The filling device includes a device to open the container and is connected to a filling hole of the balloon, in which case the pressurized gas container with filling device is secured, independent of the balloon, to the body of the user. Each balloon includes at least one pressurized gas container. The filling device for a complete, full filling of the balloons by means of the pressurized gas drawn from the pressurized gas bottles is connected via a pressure line to the filling hole of the balloon. All opening devices can be actuated via a common release mechanism.

19 Claims, 13 Drawing Sheets

SAVING APPARATUS FOR PERSONS IN AVALANCHES

This is a continuation of application Ser. No. PCT/EP96/01942 filed on May 9, 1996.

FIELD OF THE INVENTION

The invention concerns a lifesaving device for people in avalanches with at least one tear-resistant balloon, which can be secured close to the body of the user by means of an attachment and which in an emergency is inflated by means of pressurized gas so that, just like a buoyancy body, it keeps its user at the surface of the avalanche, and with a filling device to connect the balloon to at least one pressurized gas container which filling device comprises a device to open the container and is connected to a filling hole of the balloon.

In the case of a known device of this type, which is described in the German Patent Specification P3237060, among others, and which for many years has proven itself in use, an emergency backpack with two compartments is used; a balloon with a capacity of about 150 l is folded in an outer compartment; in an inner compartment there is a gas generator which is connected to a filling hole of the balloon and in the housing of which two pressurized gas cylinders are screwed in which, with the aid of a Venturi tube, fill the balloon with a gas-air mixture. The Venturi principle means that the filling takes a few seconds. Under unfavourable circumstances, for example, if the balloon was released too late by its user so that it is already caught in the avalanche before it is completely inflated, this fact can lead to a reduced buoyancy and thus jeopardize the success of the lifesaving operation. Moreover, a gas generator operating according to the Venturi principle is voluminous and technically expensive.

On the other hand, the user and the relevant rescue organizations wish for an improved device which, without problem, can be carried on the body in addition to a normal backpack and which makes possible in particular a quick and reliable filling of the balloon.

SUMMARY OF THE INVENTION

These requirements are met according to the invention in that the pressurized gas container with filling device is secured, independent of the balloon, directly to the body of the user by means of attachment elements, or indirectly by way of clothing or any other devices to be worn on the body, and that the filling device for a pure gas filling is connected via a pressure line to the filling hole of the balloon.

With this proposal, the idea of a compact device is pushed into the background; instead, one or several pressurized gas containers are to be put in suitable locations on the body of the user, in fact with accompanying filling devices to fill one or several balloons in which case, between the filling device and balloon, a pressure line, for example, in the form of flexible high-pressure tubing is provided in each case. After actuating a central release mechanism, the gas flows then as pure gas filling, preferably of nitrogen, into the balloon(s). In this case, the time of the filling operation can be optimized through suitable selection of the cross-section of the pressure line.

A particularly suitable embodiment provides that the device comprises at least two balloons and each balloon at least one pressurized gas container, and that all opening devices can be actuated via a common release mechanism. As far as the release mechanism is concerned, a device with an impact-actuated release mechanism is particularly well suited which preferably is placed on the chest. A release through impact actuation in a central place is particularly reliable. The release mechanism can also be activated in a fall which, for example, in no way is ensured by anticipation or the user having control to pull a rip cord.

A particularly preferred embodiment of such a release mechanism to be actuated by impact can comprise a housing in which a flat capsule, filled with a pressurized gas under high pressure (for example, 20 bar), is placed. The housing has furthermore a button which can be actuated from the outside and which is connected to a needle which, with a strike on the button, pierces the capsule. As a result of this, the pressurized gas flows promptly into the housing of the release mechanism and via flexible connections on to the opening device or opening devices. These comprise suitably pistons which, acted upon by the pressurized gas of the release mechanism, open the pressurized gas containers.

While it is preferable for attaining a maximum freedom of movement in the case of an embodiment with several pressurized gas bottles that these, together with their accompanying filling devices, are secured separately to the body, a common filling device to which all pressurized gas containers are connected is suitably considered in the case of an embodiment as backpack lifesaving device, known in itself. The release is carried out in particular simply here by means of a central release mechanism which is connected with the common filling device so that both pressurized gas bottles can be opened and emptied simultaneously, for example, to fill a single balloon or two balloons.

With two balloons it is suitable that each balloon, each folded in a balloon pouch, is attached just below the shoulders on both sides on the outside of the back of the user. These balloon pouches can be designed either as side pockets of an emergency backpack; they can be folded as well in vest pockets inside back vents on the sides of a vest; finally, they can be folded in side pockets on the sidepieces of a back carrier frame inside a vent of the respective side pocket.

Through this arrangement of the balloons, it is ensured that they in the inflated state, like two air bags, find space on the sides of the trunk behind the shoulders and arms. In this way, it is attained that the freedom of movement of a skier is only restricted insignificantly when the balloons are inflated, that is, the skier can by moving even attempt to escape. If he is caught in the avalanche, the close attachment of the balloons to the body results in steady buoyant forces. The two balloons keep the body in its swimming position at the surface of the avalanche in which case they counteract its rotation. They protect the body on both sides, in particular in the area of the head. If one balloon is broken and thus is emptied, the fully inflated second balloon still remains whereby the certainty of the success of the lifesaving is further increased.

The balloons are preferably dimensioned in such a way that they in the inflated state always have a columnar shape, extended in a direction parallel to the longitudinal axis of the body, in which case the columns suitably extend at least to the level of the head of the user.

From the preceding embodiments it follows that a solution using two balloons, which are placed on the sides of the back, is particularly advantageous. It does not only make possible the accommodation and carrying respectively of a standard backpack between the balloons; it can also be realized particularly well with a back carrier frame, namely in such a way that one balloon each is attached to one of two longitudinal sidepieces on the sides of a back carrier frame or—in its folded state—is integrated completely or partially in the longitudinal sidepiece or is placed therein. The pressurized gas containers can likewise be placed here in the longitudinal sidepieces of the back carrier frame or arranged on the latter. In a particularly preferred further development of the invention though, the pressurized gas containers are placed in a lower crosspiece of the back carrier frame, connecting the two longitudinal sidepieces with one another, in which case the two pressurized gas bottles suitably discharge in different directions (towards the balloons on the outside). The back carrier frame with the balloons can be used both as separate lifesaving device and as a basis for a backpack. In the last-mentioned case, specially made backpacks without carrying structure of their own can be attached to the back carrier frame in which case various backpack sizes are conceivable.

When using a vest in the back vents of which on the sides the two balloons are folded, the embodiment suggests in addition that the vest is provided with a trouser part which can have outside pockets in the thigh area to accommodate the pressurized gas bottles. The trouser part, which in addition ensures the secure fit of the vest on the body of the user, is here preferably designed as short trousers, of which the legs can be open along the inside of the thighs to be easy to put on, can be provided, however, with fasteners.

In addition to this, or also alternatively to the trouser part, the secure fit of the best on the body of the user when using the device according to the invention is ensured in that the vest, at least on its front, has inflatable compartments which are connected to the path of the pressurized gas for filling the balloons. Through the inflation of these compartments with the pressurized gas flowing to the balloons, the vest, including the trouser part if applicable, attains a secure fit on the body of the user so that the latter, at least after actuation of the release, cannot slip out of his safety clothing even if the latter has a loose fit before the inflation of the compartments; the inflated compartments, moreover, do not only form an additional buoyancy device but ensure an additional protection against injuries.

For vests which do not have a trouser part in accordance with the previous embodiments, the pressurized gas container(s) is or are placed according to a preferred, further development of the invention in a "belt pouch" which forms an extended back part of the vest. The vest needs otherwise only to have straps or the like in the back; excessive sweating by the user is avoided through a suitable "open" design.

It is obvious that for the balloons, non-return valves are suitable at the connections of the pressure lines or tubes by means of which the flow direction of the pressurized gas is ensured during the filling operation and the pressurized gas is kept in the balloons. This applies only to a limited extent to the inflatable compartments in the clothing (vest) elucidated above. But non-return valves can also be provided here which keep the compartments permanently filled. However, it is in particular preferred that the compartments in the clothing (vest) can be emptied gradually in a controlled way by means of a discharge valve, for example, in about 5 minutes. In this way, the pressure on the thorax is reduced for a person who, in spite of using the device, was buried by an avalanche; and the volume occupied earlier by the inflated compartments is available to the buried person for breathing.

By turning away from the known Venturi principle, the rapid filling of the balloons becomes possible by means of a simple filling device. An advantageous embodiment consists in that its opening device for a pressurized gas bottle has a needle to pierce its seal plate which is seated in a needle holder that can be actuated pneumatically or by means of spring force relative to a guide channel which is sealed to the outside. If a relative movement between needle holder and guide channel is produced by a suitable release mechanism, the point of the needle penetrates the seal plate and the pressurized gas can flow into a chamber from where it reaches the balloon via a pressure line, pressure tubing or the like. Each pressurized gas bottle is provided with a filling device; all filling devices are connected to a central release mechanism.

A suitable variant consists in that the pressurized gas bottle with an external thread of its neck part, forming the opening, is accommodated in a housing part containing the guide channel. In this way, it is not only ensured that the needle can be positioned very close in front of the seal plate; also the release can take place with particular ease by arranging the pressurized gas bottle under tension by means of spring force in a direction against the needle in such a way that when releasing a locking device through actuation of the release mechanism, the pressurized gas bottle with its seal plate is knocked over the needle.

Extruded steel bottles are less suited as pressurized gas containers since these are relatively heavy. For weight reasons, flexible high-pressure tubes of plastic or rubber are better suited in which case one or several flexible high-pressure tubes can be incorporated in the belt or such belt components attached to the body of the user.

More suitable pressurized gas bottles of light metal consist preferably of an aluminium alloy with high tensile strength which are made from a blank by machining. To realize a bottle of usual shape, it is here suitable that the pressurized gas bottles are comprised of two or several parts. In a suitable embodiment, it is provided that the pressurized gas bottles in each case are comprised of an inner sleeve having the bottle opening, and a cap component screwed over its open end opposite the bottle opening. The screwing together is here done in such a way that both bottle components are sealed together in the thread area in which case the final screwed position is determined by means of simultaneous calibration of the volume. In this way, a pressurized gas bottle with very accurately measured capacity can be produced and the filling pressure of the balloons can be set sufficiently accurate at about 1.2 bar. Usual bottle sizes with a volume of about 200 $cm^3$ are used for each balloon in which case for a person of average weight, each balloon is filled with about 70 $cm^3$ gas.

In the following, several exemplified embodiments of the invention are elucidated by means of the drawing. Here,

DETAILED DESCRIPTION OF THE INVENTION

Figure 1:
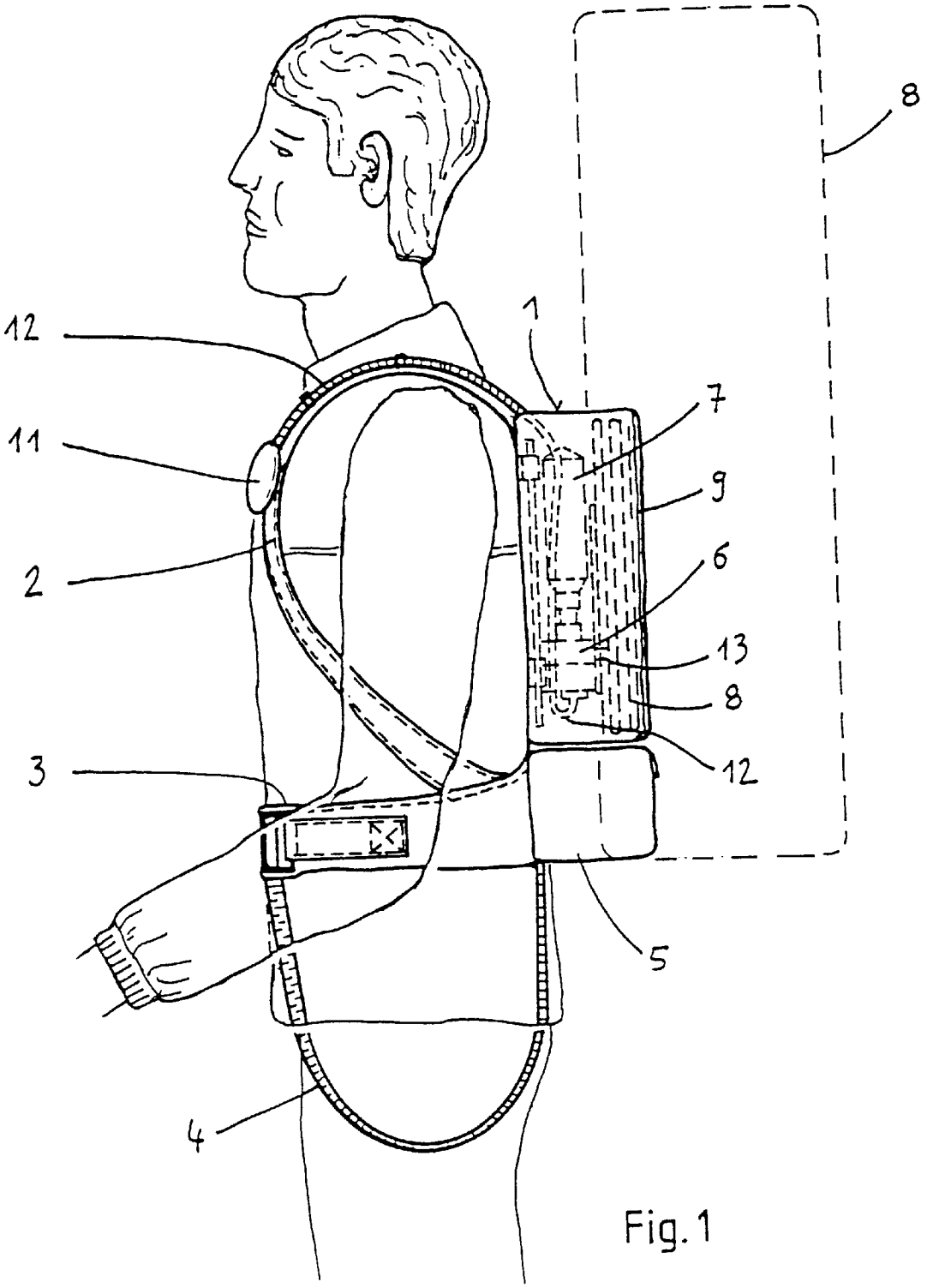
FIG. 1 shows a side view of an emergency backpack with a filling device for two pressurized gas bottles.
Figure 2:
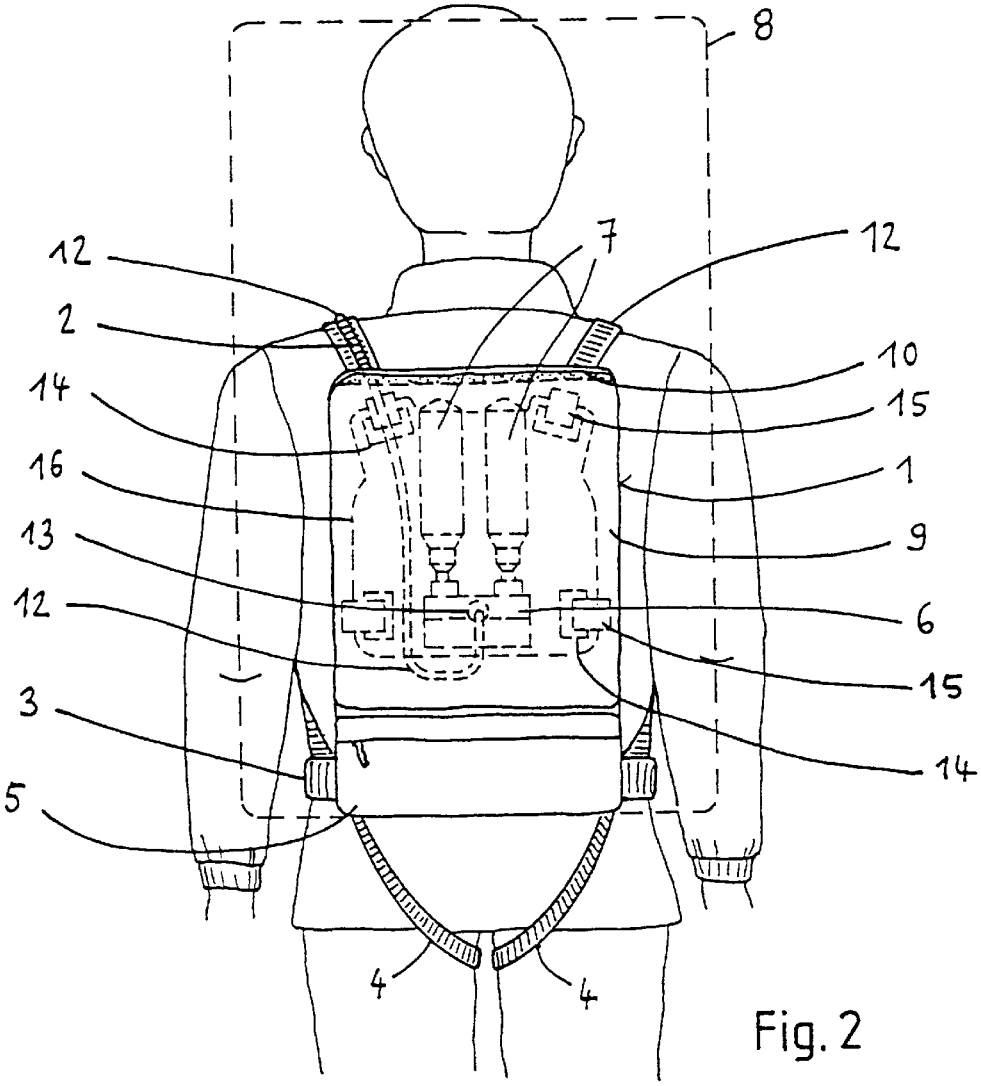
FIG. 2 shows a view of the emergency backpack according to FIG. 1 on the back of the user.

FIG. 1 shows the user of an emergency backpack 1, who carries the latter in secured position on his body by means of carrying straps 2 on the sides, a belt 3 and two leg straps 4. Onto the bottom side of the backpack 1, a flat belt pouch 5 is sewn which serves as storage space for additional objects. The actual emergency backpack 1 comprises a filling device 6 for two pressurized gas bottles 7 as well as the folded balloon 8 inside a back wall 9 of the backpack which, for example, along its top edge is secured by means of a Velcro fastening band 10 (FIG. 2). At chest level of the left carrier strap 2 of the user, an air pressure pump 11 is represented as release which is connected via an actuation tube 12 to the bottom of the filling device 6. The filling device 6 is also connected via a short pressure line or conduit 13 to the interior of the balloon 8 which also is represented in the inflated state by a broken line. Flexible high pressure tubing(s) 12 may be incorporated in belt 3 or such belt components attached to the body of the user.

In FIG. 2, the emergency backpack 1 according to FIG. 1 is represented, seen against the back of the user. It can be seen that the filling device 6 and the two pressurized gas bottles 7 are disposed on a mounting plate 16, which in the corner areas has ears 14 through which loops 15, attached to the inside wall of the backpack, are threaded in order to secure the mounting plate 16.

In the representation according to FIG. 2, the balloon as such is not shown in the folded state; one sees, however, the opening of the pressure line 13 in the upper area of the filling device 6.

Figure 3:
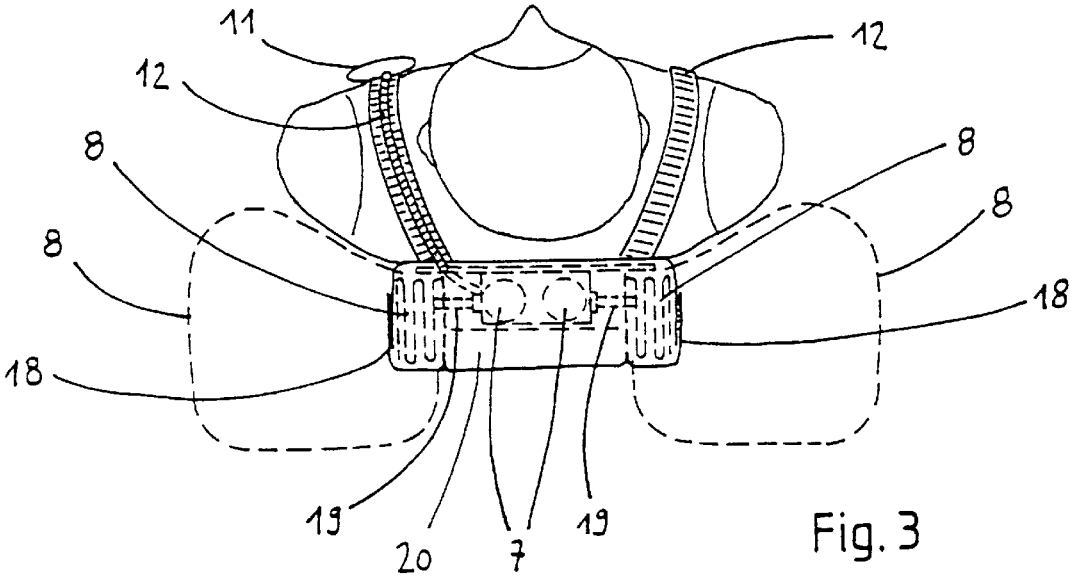
FIG. 3 shows a top view of an emergency backpack according to FIGS. 1 and 2, but with 2 balloons on the sides.

In FIG. 3, a top view of the emergency backpack 1 is represented, but as a variant with two balloons 8 on the sides. The balloons 8 are on the sides in the backpack, i.e. placed folded behind its side walls 18, in which case the side walls 18 have longitudinal vents, not shown in detail, which again are secured with Velcro fastening bands. When the balloons 8 are inflated, these vents open immediately so that the balloons 8 can unfold to the side until they are fully filled as represented by the broken line. The two balloons 8 are connected by means of pressure lines 19 on the sides to the filling device 6 which again can be actuated by a release mechanism as already described for FIGS. 1 and 2. In the location of the balloon pouch for the large balloon 8 according to FIGS. 1 and 2, there is another storage space 20 which is available for smaller luggage.

Figure 4:
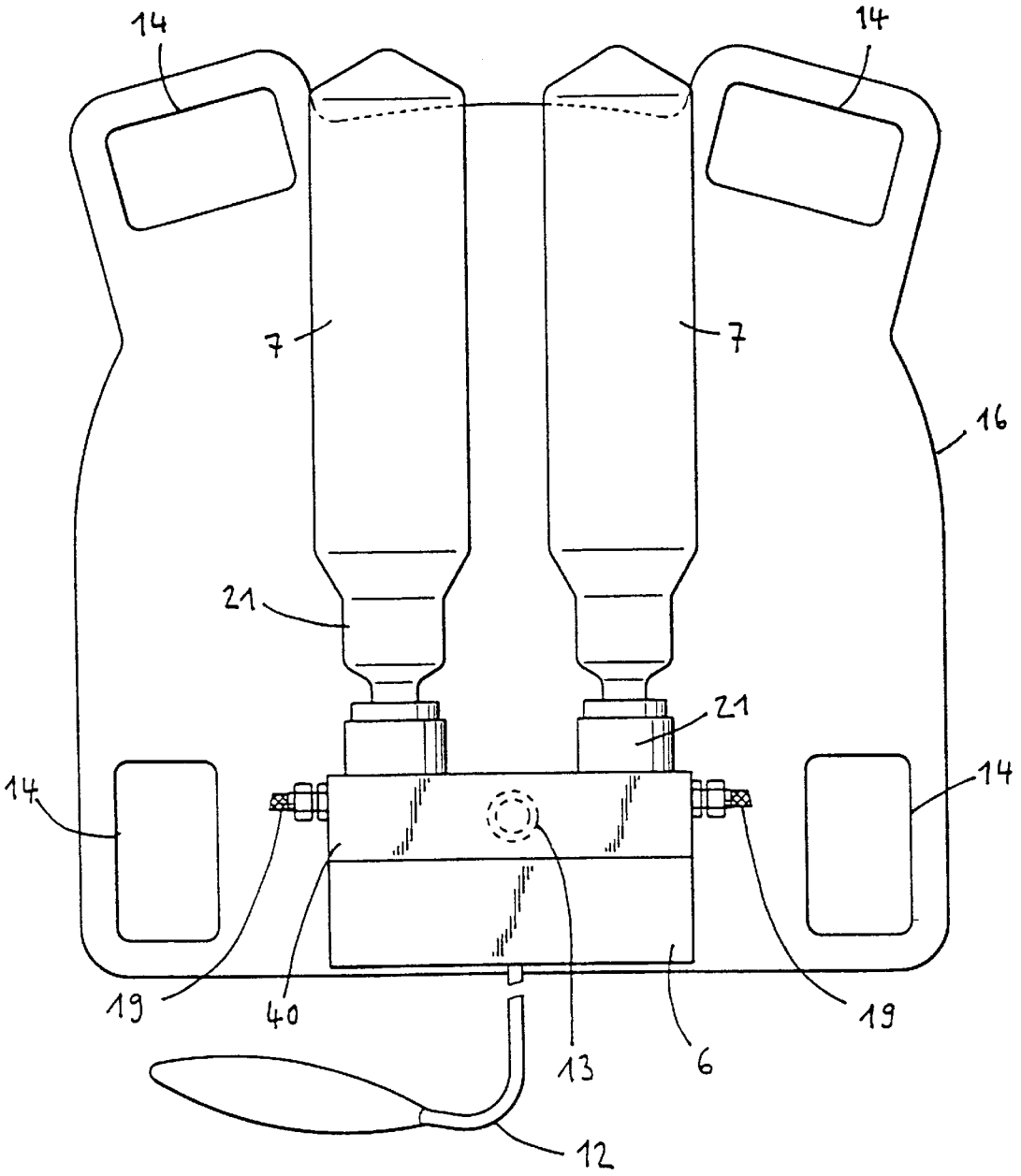
FIG. 4 shows a filling device for an emergency backpack according to FIGS. 1–3.

In FIG. 4, the mounting plate 16 is shown enlarged once more with the four ears 14 in the corner areas. Onto it, the filling device 6 is mounted into the top side of which two bottle-shaped pressurized gas containers 7 are screwed in corresponding threaded sleeves 21. The pressurized gas container is designed as flexible high-pressure tubing of plastic or rubber. On the housing of the filling device 6, the pressure lines 19 on the sides are connected to the balloons 8 on the sides. The short pressure line 13 for the alternative connection to a central balloon is drawn-in with broken lines in the middle of the upper housing part 40 of the filling device 6.

Figure 5:
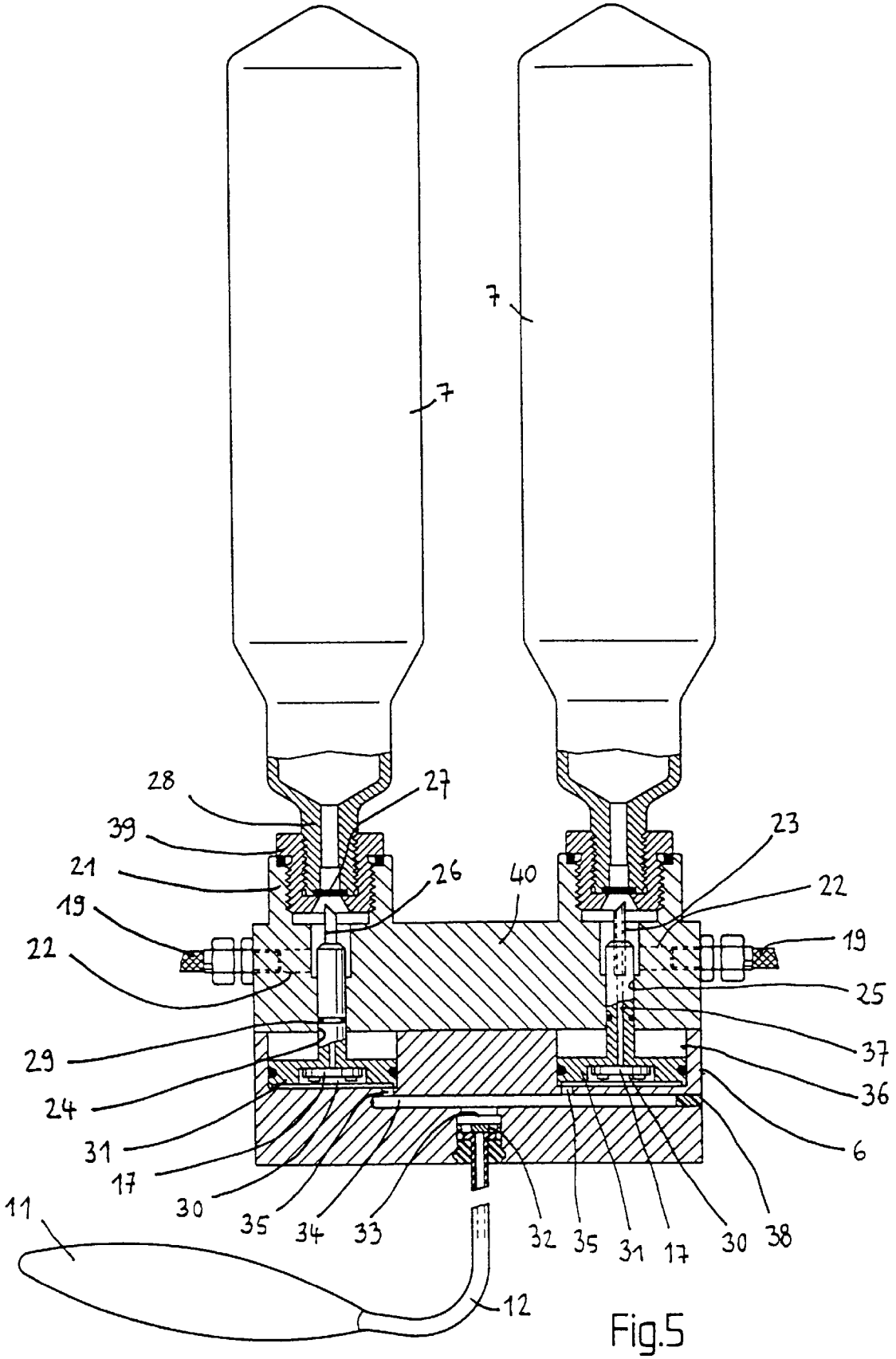
FIG. 5 shows a cross-section of the filing device according to FIG. 4.

FIG. 5 shows in a sectional representation the filling device according to FIG. 4 with pressure lines 19 connected to the sides. These are, via housing bores 22, connected with a pressure chamber 23 into which the guide channel 24 for the needle holder 25 opens. The bevel point of the needle 26 attached in the needle holder 25 is just in front of the seal plate 27 of the corresponding pressurized gas bottle 7 of which the neck 28 is screwed by means of an external threaded into a sealing sleeve 39 which in turn sits in a threaded sleeve 21 of the filling device 6. The two needle holders 25 are sealed against the guide channels 24 by means of packing rings 29 so that the pressurized gas cannot escape downwards after the piercing of the pressurized gas bottle.

The opening of the pressurized gas bottles 7 is triggered by a blow on the pressure pump 11 which is transmitted through the actuation tube 12 via a connection in the housing of the filling device 6 to the pressure chambers 30 of two pistons 31, on each of which one of the aforementioned needle holder 25 is formed. A pressure wave in the actuation tubing 12 arrives in each case via a non-return valve 32, a central bore 33, a cross hole 34 and two outlet bores 35 into the pressure chambers 30 of the pistons 31 which in this way are driven upwardly by fluid pressure inside their respective guide cylinders 36 until the needles 26 pierce the seal plates 27. Each needle holder 25 has a central bore 37 which continues through the hollow needle 26. In this way, the complete stroke movement of the needle 26 is ensured by the pressurized gas emerging into the pressure chamber 30. At its lower opening, the central bore 37 is sealed by a leaf-shaped, downwards open non-return valve 17.

For completeness sake only it is further mentioned that the cross hole 34, through which the opening devices of both pressurized gas bottles 7 are connected with one another, is sealed at the outlet from the housing of the filling device 6 by means of a plastic plug 38.

Figure 6:
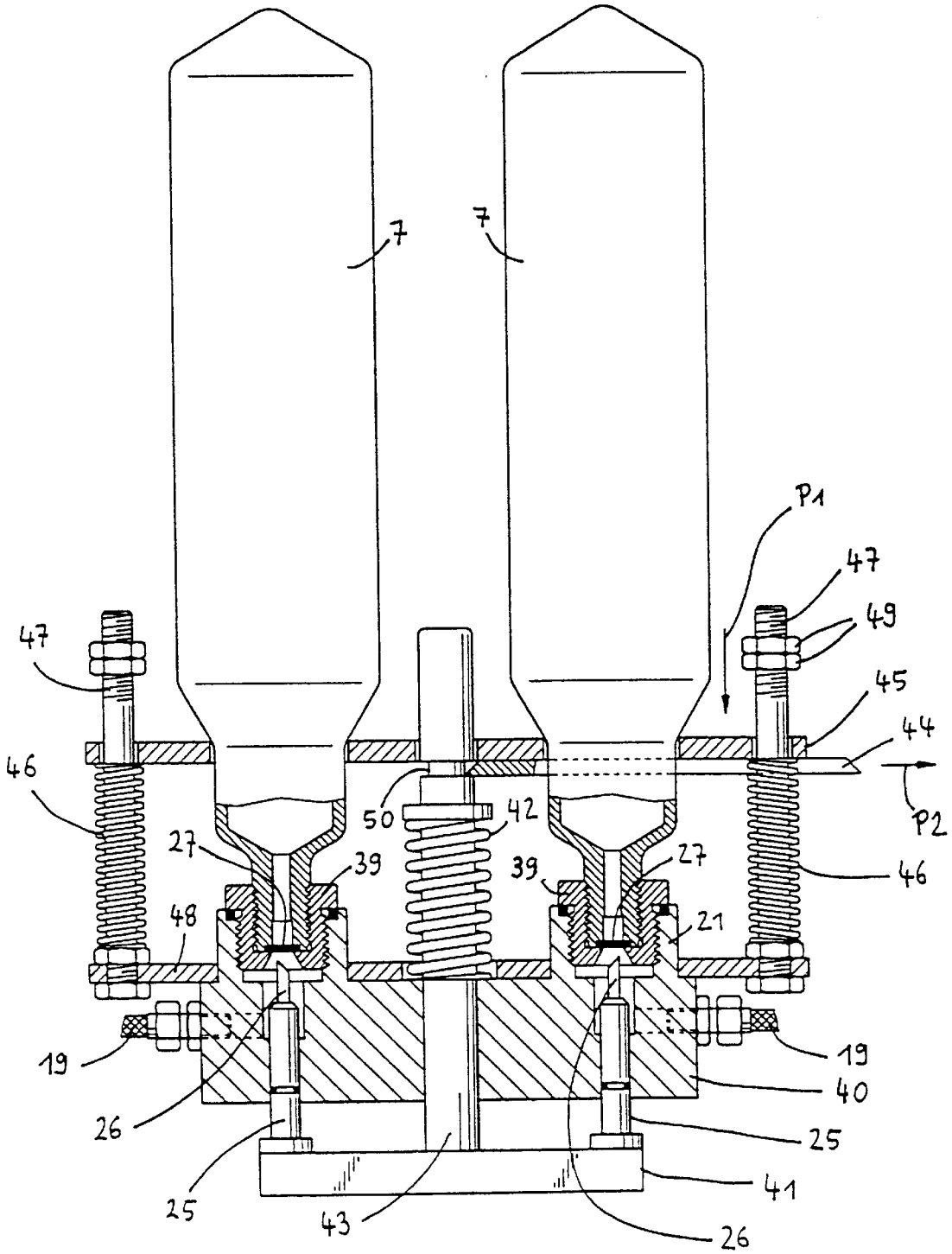
FIG. 6 shows a cross-section of a first variant of a filling device with two pressurized gas bottles.

FIG. 6 shows another embodiment of a filling device 6 in which the upper section of the housing 40 of the filling device, including the connection for the two pressurized gas bottles 7, is designed as in FIG. 5 so that a detailed description, including the needle holder 25 with needle 26, is not needed. The two needle holders 25 are mounted on a common base plate 41 which is put under initial tension, by means of a compression spring 42 mounting around a central guiding rod 43 connected with the base plate 41 and locked in an initial position thereof by a sliding plate 44. The initial tension is produced by pressing down the sliding plate 44 according to arrow P1 by means of a clamping plate 45 through the openings of which the pressurized gas bottles 7 are screwed in which case they, with their wider container section, take along the clamping plate 45. The clamping plate 45 is here supported on the side by compression springs 46 which are placed around side guide bolts 47 which are shortened with increasing screwing-in of the pressurized gas containers. Both guide bolts 47 on the sides are in each case fastened with their lower end to a support plate 48, which is supported on the top side of the upper part 40 of the filling device 6. If the slide plate 44 is removed by means of a release mechanism by pulling in the direction of the arrow P2, the compression spring 42 extends promptly, i.e. the base plate 41 accordingly is knocked upwards in which case the two seal plates 27 are pierced by the needle points of the needles 26.

To replace the empty bottles, the latter are unscrewed from the sealing sleeves 39 whereby the clamping plate 45 is carried upwards by the compression springs 46 until the pressurized gas bottles 7 are removed and the clamping plate 45 lies against the bottom side of the threaded nuts 49 screwed onto the side guide bolts 47. After that, the slide plate 44 is again brought in locking position in which its inside end enters in the annular groove 50 of the centre guide bolt 43. When new pressurized gas bottles are screwed in, the clamping plate 45, together with the slide plate 44, is again moved downwards in which case the compression springs 42, 46 tension again and the base plate 41 is again brought in the initial position shown in FIG. 6.

Figure 7:
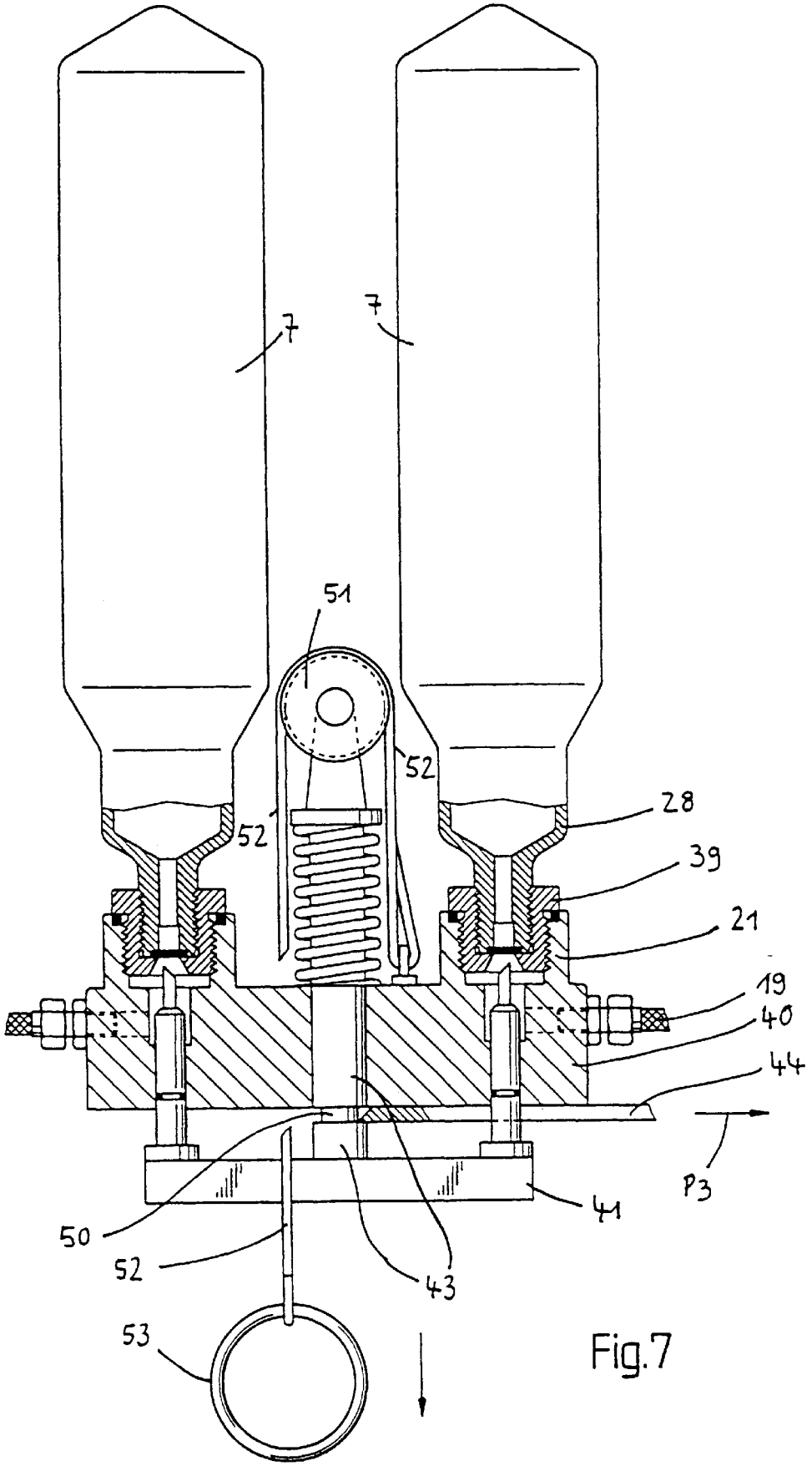
FIG. 7 shows a cross-section of a second variant of a filling device with two pressurized gas bottles.

Differing from the embodiment according to FIG. 6, the tensioning of the base plate 41 in the embodiment according to FIG. 7 does not occur through the screwing-in of the pressurized gas bottles 7, but by means of a special tensioning device. At the upper end of the central guiding rod 43 a guide pulley 51 is supported around which a tensioning cord is wound of which the upper end is connected to the upper housing section 40 of the filling device 6 and of which the lower end is provided with a pull ring 53. If one pulls the pull ring 53, the compression spring 42 of the central guiding rod 43 is shortened between an end stop 54 of the central guiding rod 43 and the top side of the upper housing part 40 until the inside end of the locking device 44 enters in the annular groove 50 of the tension bolt 43. The release of the two opening devices takes then place as already described in connection with FIG. 6 by pulling the locking device 44 in the lateral direction according to arrow P3.

Figure 8:
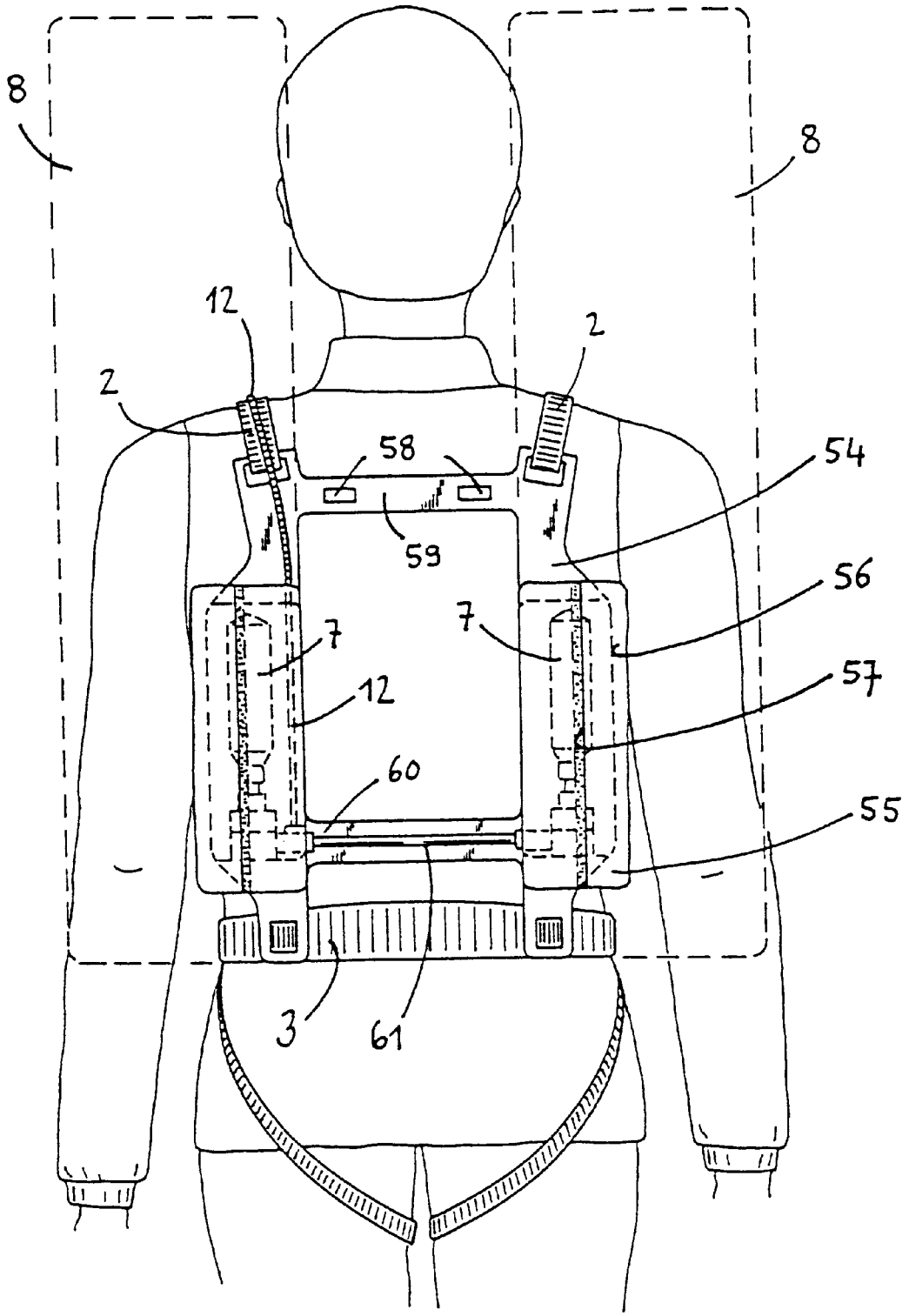
FIG. 8 shows a back carrier frame with pressurized gas bottles arranged at the sides.

In FIG. 8, a variant of a lifesaving device is represented which in its basic design is closest to the embodiment according to FIG. 3. Instead of a lifesaving device in the form of a backpack, the latter is arranged on a back carrier frame 56 in the case of which the two pressurized gas bottles 7 as well as suitable side pockets 55, in which the balloons 8 on the side are folded, are provided in the area of the vertical sidepieces 54. Both side pockets 55 have vertically extending vents 57 with Velcro fasteners through which each balloon 8 emerges when it is filled with gas. On such a back carrier frame 56, it is advantageous that in the centre area of the back sufficient space is available to put a backpack, for the attachment of which the two upper ears 58 in the upper crosspiece 59 of the back carrier frame 56 are provided.

In this embodiment of the lifesaving device, two separate filling devices are provided which each is attached to a pressurized gas bottle 7. Both filling devices are connected in the area of the lower crosspiece 60 of the back carrier frame 56 by means of a connecting tubing 61 which ensures the joint release of the opening devices of the two filling devices. In the present case, as already described for FIGS. 1 to 5, this can be a compressed air release mechanism with flexible actuation tubing 12 which is connected to the connecting tubing 61.

Figure 9:
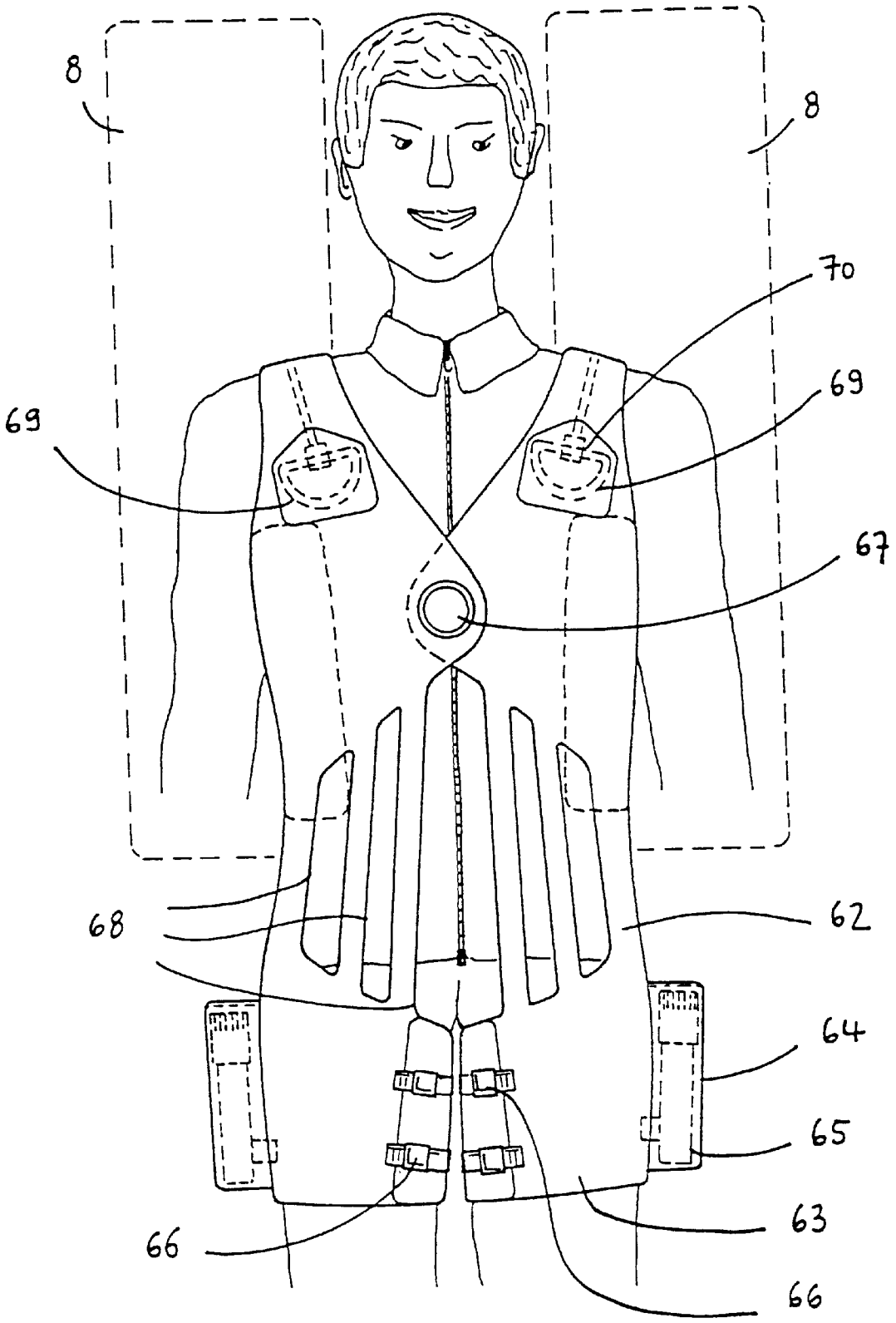
FIG. 9 shows a front elevational view of a lifesaving vest.
Figure 10:
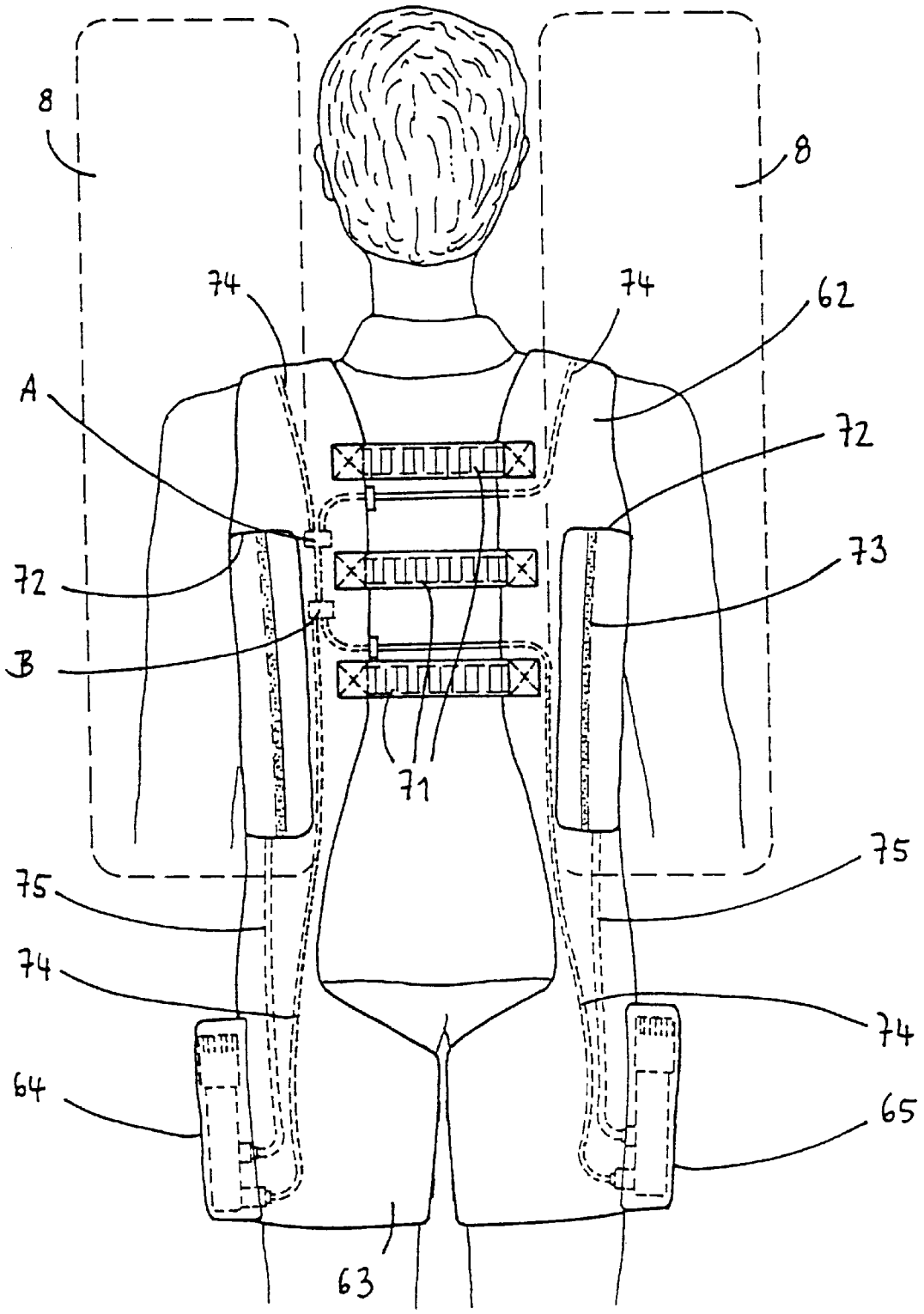
FIG. 10 shows the lifesaving vest according to FIG. 9 seen on the back of the user.

FIGS. 9 and 10 show a lifesaving vest 62 to which short trousers 63 are fashioned. In the area of the thighs, the trouser legs have outside pockets 64 in which are inserted cases 65 to accommodate the pressurized gas bottles. These cases 65 with their components are described in more detail with reference to FIG. 12. The legs of the trouser parts 63 are open on the inside of the thigh and provided with fasteners 66. The vest, together with the trousers, can in this way by put over the shoulders and then the trouser part can be fastened in the leg area so that a pulling off or pulling upwards of the vast during an emergency is eliminated. The vest is worn over the clothing; it has in the middle a fastening button 67 and below that various air vents 68. For the release, two grips 69 are provided in the upper chest area which are covered by fabric flaps 70 to avoid accidental release. On the back, the vest 62 is open and kept together by means of tension fasteners 71. On the sides, behind the arms, one sees the vest pockets 72 with vertical back vents 73 along Velcro fastener bands which tear open in the unfolding of the balloons. At the back of the vest 62 release cords 74 are placed in such a way that when actuating any of the two grips 69, both pressurized gas bottles are in each case opened in order to inflate one balloon 8 each. For this purpose, the release cords 74 are brought together and joined into one cord in the area between the points A and B. In this way, it is ensured that both cords are pulled when pulling one of the grips 69 so that a simultaneous opening of the pressurized gas bottles in the cases 65 can take place. Both cases 65 are connected via pressure lines 75 to the balloons 8 placed in the vest pockets 72.

Figure 12:
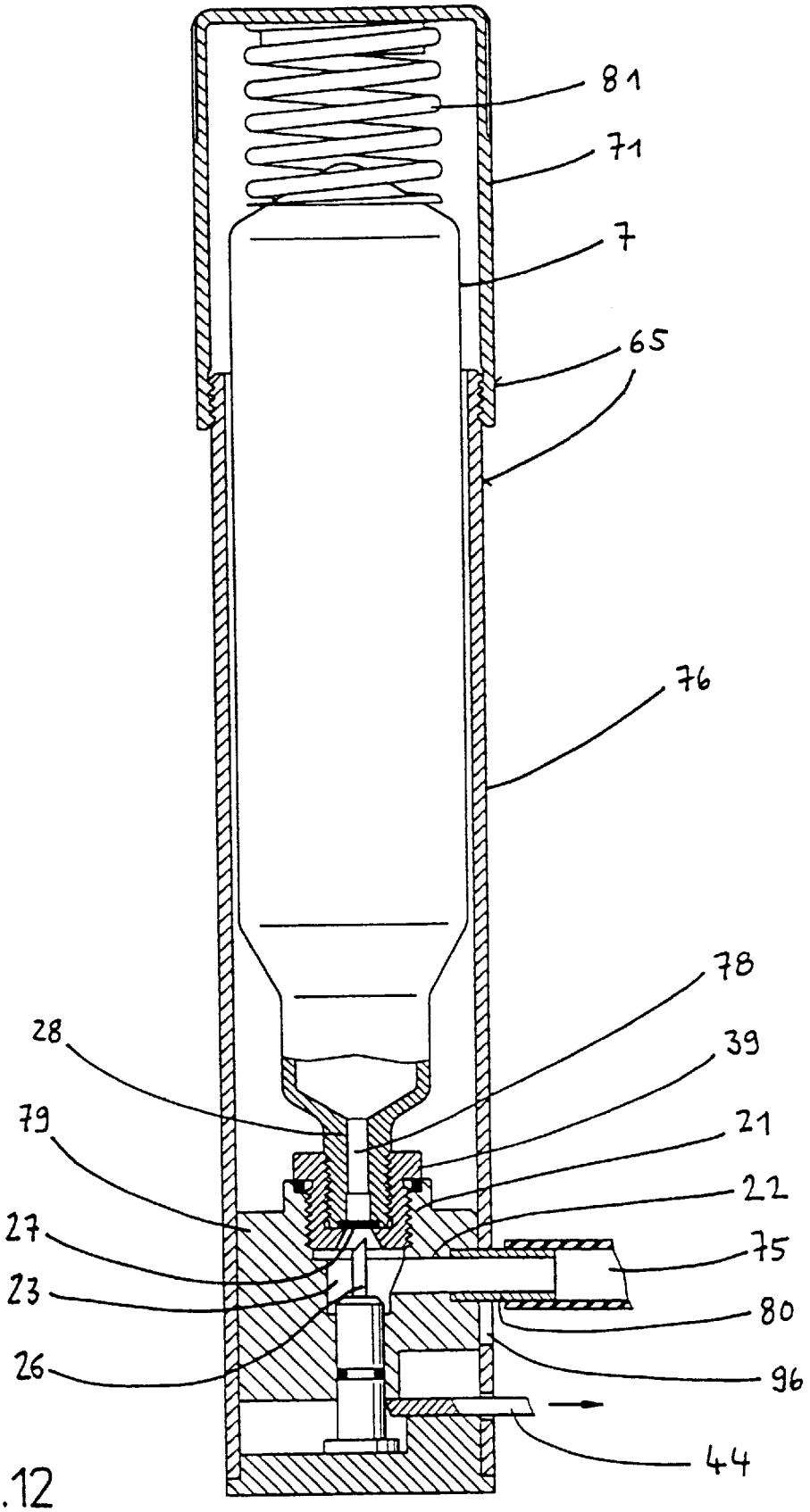
FIG. 12 shows a pressurized gas bottle in a case with mechanical release.

A cross-section of a case 65 for the best according to FIGS. 9 and 10 is represented in FIG. 12. It consists of a cylinder part 76 onto which a cover part 77 is screwed. The pressurized gas bottle 7, with its neck section 28 forming the bottle opening 78, is screwed in a sealing sleeve 39 which again is accommodated in a threaded sleeve 21 of a piston component 79. A pressure chamber 23 with the needle 26 is inside the piston component 79. The pressure chamber 23 is connected to a pressurized gas channel 22 which is connected to the filling hole of a balloon 8 via a tubing connection piece 80 and the pressure tubing 75. By pulling the release cord 74, the sliding plate 44 is disengaged and the piston component 79, together with the pressurized gas bottle 7, strikes downwards over the needle 26 which pierces the seal plate 27 of the pressurized gas bottle 7. This strike movement of the pressurized gas bottle takes place under the effect of the compression spring 81 compressed between its upper end and the cover 77 of the case. By means of a slot 96 in the wall of the case, it is ensured that the tubing connection piece 80 can be moved along with the piston component 79. This small stroke movement is easily compensated for by the flexible pressure tubing 75.

Figure 11:
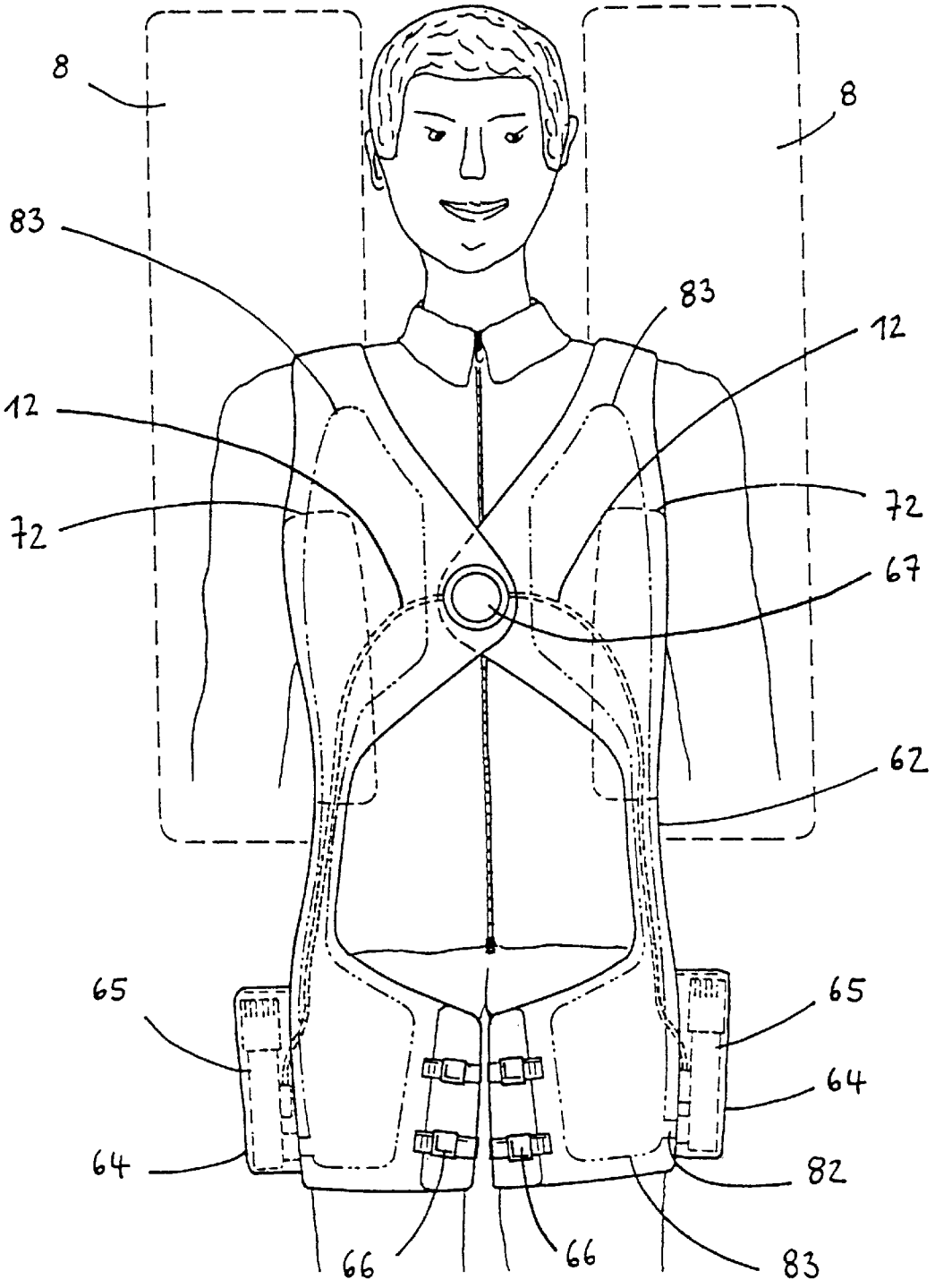
FIG. 11 shows another embodiment of a lifesaving vest.

FIG. 11 shows likewise a lifesaving vest similar to the embodiment according to FIGS. 9 and 10. The centre fastening button 67 is here used as release mechanism to trigger by impact the opening device. This release mechanism is connected via actuating tubes 12, branching off to the sides, to the respective filling device which similar to FIGS. 9 and 10 is placed in cases 65 at the sides. Particulars with regard to these cases and their components are described further below in connection with FIG. 13. A pressure gas line 82 leads from each of the two cases 65 to the balloons 8 which are placed folded in the vest pockets 72 on the sides. The pressure gas line 82 is connected to pressure chambers 83 which are incorporated both in the trouser legs and in the chest area of the vest 65. These pressure chambers 83, which are inflated in series with the balloons, are used to produce immediately other buoyancy bodies around the body of the user, additionally pad the body of the user, and besides that ensure a secure fit of the lifesaving vest. Therefore, in normal use, thus apart from emergency use, the lifesaving vest can sit relatively loose so that it does not hinder the user in his movements.

Figure 13:
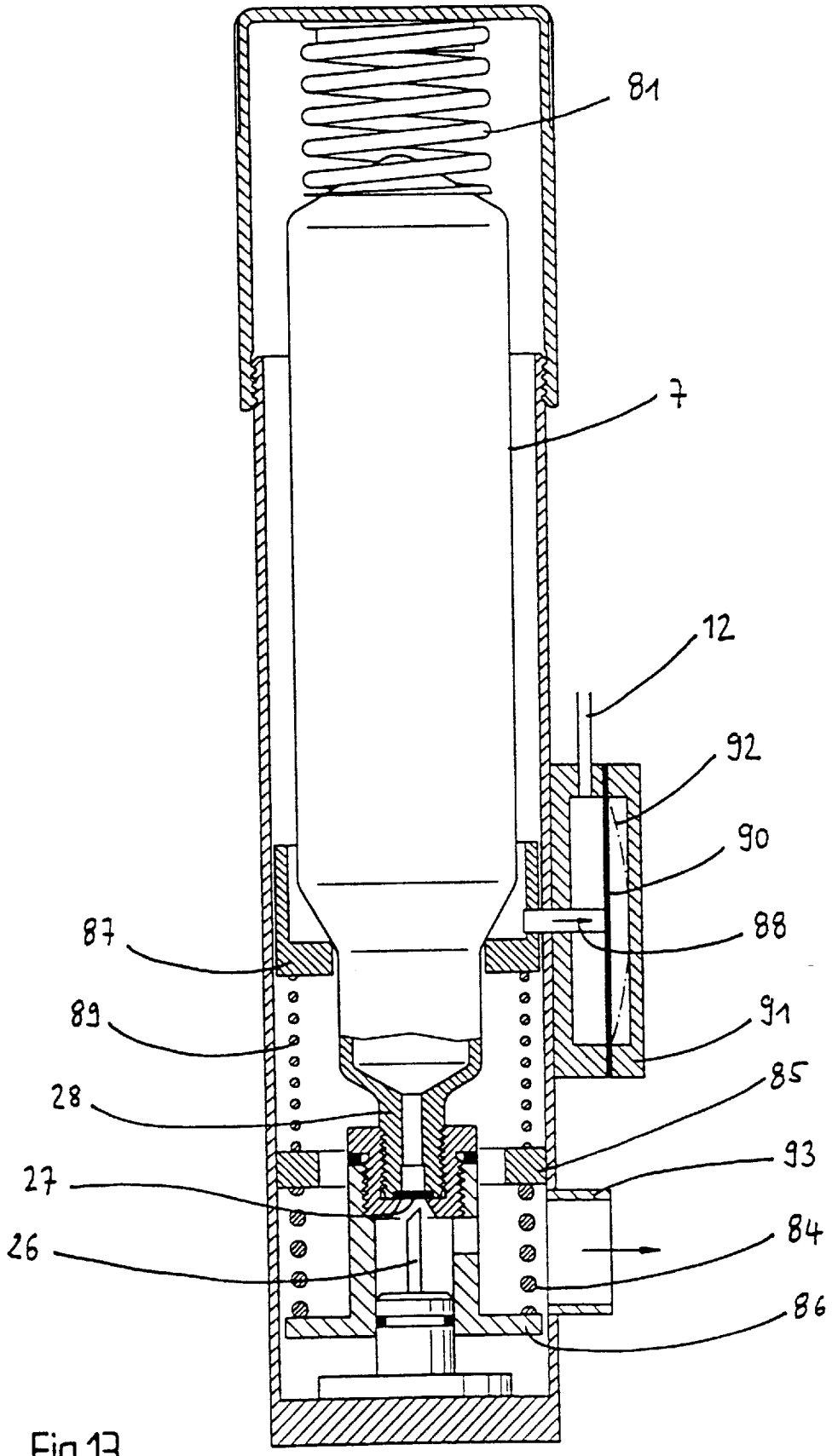
FIG. 13 shows a pressurized gas bottle in a case with pneumatic release.

In the case of the filling device according to FIG. 13, a total of three compression springs are present in which case the upper compression spring 81 can be omitted. In its place there is then only the striking spring 84 which is compressed between a ring 85 fixed to the housing and a collar component 86 connected to the neck part 28 of the pressurized gas bottle 7. The pressurized gas bottle 7 is held by means of a retainer ring 87 which is fixed in the direction of displacement of means of a locking bolt 88. Between the retainer ring 87 and housing ring 85, a return spring 89 is compressed of which the function is to move, after the release of the locking bolt 88, the retainer ring 87 upwards again so that the locking bolt 88 again can be inserted. The actuation of the locking bolt 88 takes place by impact release to actuate the striking mechanism in the fastening button 67 of the vest 62. In this case, a shock wave is generated in the actuation tubing 12 which deforms a membrane 90, connected with the locking bolt 88, against the membrane housing 91 so that it takes the shape 92 marked by the dot-and-dash line. In doing this, the inside end of the locking bolt 88 is pulled out of the corresponding boring of the retainer ring 87 and the retainer ring 87 is released so that the latter, together with the pressurized gas container 7, can be struck downwards due to the action of the striking spring 84 in which case the needle 26 again pierces the seal plate 27. The gas flowing from the pressurized gas bottle 7 reaches through the connection piece 93 the pressure gas line 82 (FIG. 11) and from there via the pressure chambers 83 of the vest 62 through (sic) the filling hole of the balloon 8.

Figure 14:
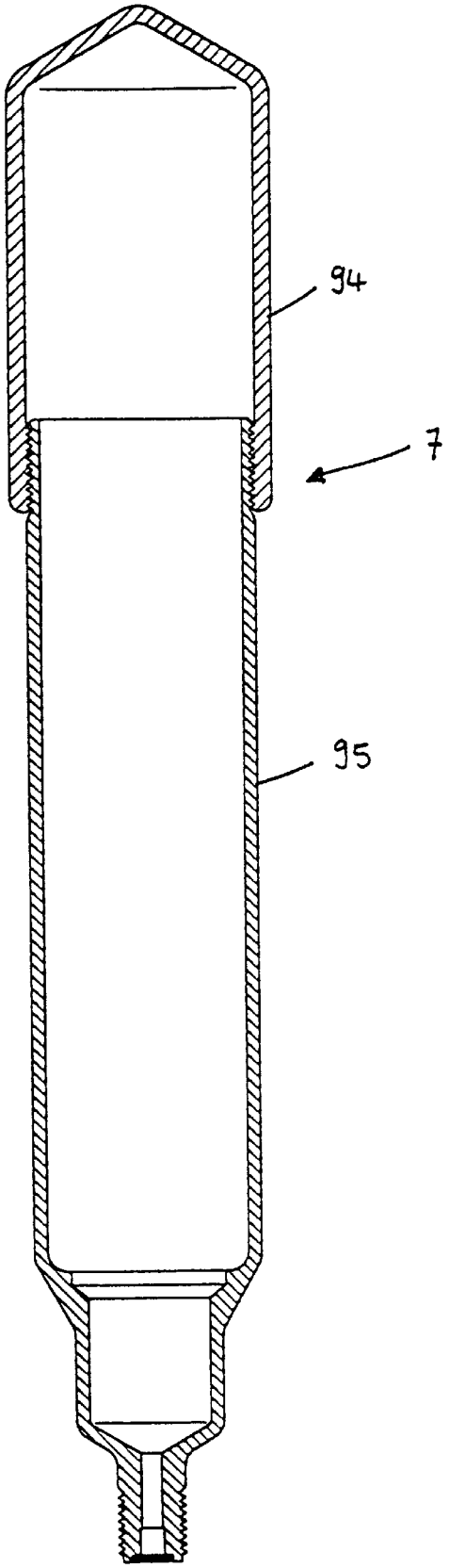
FIG. 14 shows a cross-section of a novel pressurized gas bottle.

FIG. 14 shows a specially made two part pressurized gas bottle 7 of an aluminium-manganese-copper alloy of which the distinguishing feature is a particularly high compressive strength of about 500 $N/mm^2$. The disadvantage of this material is that it cannot be worked by deep drawing. On the contrary, the two parts of the pressurized gas bottle, namely the cap part 94 and the cartridge part 95, have to be made by machining of suitable blanks. In the screw connection between the two parts adhesive is filled which hardens, afterwards the final screwed position is obtained through continuous calibration of the volume to determine a certain volume value. The total weight of the bottle for a filling volume of about 200 $cm^3$ is about 240 g and thus about 50% lower as compared to pressurized gas bottles of steel with the same volume.

What is claimed is:

1. Lifesaving device for a user in an avalanche, said life saving device comprising at least two balloons, each balloon of said at least two balloons is connected via at least one filling device to and filled by at least one pressurized gas container, at least one balloon of said at least two balloons, is tear-resistant, said device including a means for attaching the balloons close to the user's body, said at least two balloons in an emergency are inflatable by means of pressurized gas so that each balloon of said at least two balloons, just like a buoyancy body, keeps the user at the surface of the avalanche, and said at least one filling device comprises at least one opening device to open the at least one pressurized gas container and is connected to a filling hole of each balloons of the at least two balloons, the at least one pressurized gas container with said at least one filling device is securable independent of each balloon, of said at least two balloons, to the body of the user, and the at least one filling device for a complete, full pure gas filling of said at least two balloons by means of the pressurized gas drawn from the at least one pressurized gas container is connected via a pressure line to the filling hole of each balloon of said at least two balloons, and that said at least one opening device is actuatable via a common release mechanism wherein upon actuation the at least two balloons are at least partially below the shoulders on both sides on the outside of the back of the body of the user and parallel to the longitudinal axis of the body of user when attached to the user by the means for attaching, said balloons are connected to said means for attaching such that when inflated the position of said balloons relative to said means for attaching will not substantially change from when said balloons are not subjected to forces of the avalanche to when said balloons are subjected to said forces.

2. Lifesaving device according to claim 1, wherein the balloons are folded in respective balloon pouches in said means for attaching, said pouches being positioned such that said pouches can be disposed on both exterior sides of the user's back, respectively, just below user's shoulders.

3. Lifesaving device according to claim 2, wherein the balloons in the inflated state have in each case a columnary form, wherein when attached to the user said balloons extend in the direction parallel to the longitudinal axis of the body.

4. Lifesaving device according to claim 3, wherein the balloons (8) in the inflated state extend at least up to head level of the user when attached.

5. Lifesaving device according to claim 1, wherein the pressurized gas container is designed as flexible high-pressure tubing of plastic or rubber.

6. Lifesaving device according to claim 5, wherein the flexible high pressure tubing is incorporated in a belt attachable to the body of the user.

7. Lifesaving device according to claim 1, wherein said means for attaching includes a mounting plate configured to hold said at least one pressurized gas container and said at least one filling device, said mounting plate is securable to the body in a backpack or to a back carrier frame and which has ears for the attachment of straps.

8. Lifesaving device according to claim 1, wherein at least one pressurized gas bottle (7) of light metal is provided as the least one the pressurized gas container.

9. Lifesaving device according to claim 8, wherein at least one pressurized gas bottle (7) is composed of an aluminum alloy with high tensile strength and is made from a blank by machining.

10. Lifesaving device according to claim 9, wherein the at least one pressurized gas bottle (7) is comprised of at least two parts.

11. Lifesaving device according to claim 10, wherein the at least two parts include an inner cartridge part having a bottle opening and a cap part screwed on the inner cartridge part.

12. Lifesaving device according to claim 11, wherein the inner cartridge part and the cap part are sealed in a threaded area of the bottle.

13. Lifesaving device according to claim 12, wherein a final screwed position of the inner cartridge part and the cap part is determined by simultaneous calibration of a volume of the bottle.

14. Lifesaving device according to claim 1, wherein said at least one opening device for the at least one pressurized gas container has a needle to pierce a seal plate which is seated in a needle holder that can be actuated pneumatically or by means of spring force relative to a guide channel.

15. Lifesaving device according to claim 14, wherein the at least one container has a neck part (28), forming an opening (78) and having an external thread formed thereon, said neck part being accommodated in a housing part (40) containing the guide channel (24).

16. Lifesaving device for a user in an avalanche said lifesaving device comprising at least two tear-resistant balloons, a filling device and at least two pressurized gas containers, said device including a means for attaching the balloons, close to the user's body on both sides of the back of the user at least partially below the shoulders of the back of the user and parallel to the longitudinal axis of the body of the user, each of said balloons being connected to at least one of said pressurized gas containers via said filling device, said filling device includes an opening device for each balloon to open the containers, said filling device is connected to a filling hole of each of said balloons such that in an emergency said balloons may be inflated by means of pressurized gas so that said lifesaving device just like a buoyancy body, keeps its user at the surface of the avalanche said balloons are connected to said means for attaching such that when inflated the position of said balloons relative to said means for attaching will not substantially change from when said balloons are not subjected to forces of the avalanche to when said balloons are subjected to said forces.

17. Lifesaving device according to claim 16, wherein said pressurized gas containers with filling device (6) may be secured, independent of the balloons, directly to the body of the user by means of attachment elements.

18. Lifesaving device according to claim 16, wherein said filling device (6) is designed for a complete, full filing of said balloons by means of pressurized gas drawn from said pressurized gas containers.

19. Lifesaving device according to claim 16, wherein said filling device is connected via a pressure line (13, 19, 75, 82) to said filling holes of said balloons, and that said opening device for each balloon can be actuated via a common release mechanism.

* * * * *